US005191774A

United States Patent [19]

Park

[11] Patent Number: 5,191,774

[45] Date of Patent: Mar. 9, 1993

[54] REFRIGERATING COMPARTMENT TEMPERATURE CONTROL DEVICE

[75] Inventor: Suk Heang Park, Suweon, Rep. of Korea

[73] Assignee: Samsung Electronics Co., Ltd., Suweon, Rep. of Korea

[21] Appl. No.: 765,686

[22] Filed: Sep. 26, 1991

[30] Foreign Application Priority Data

Sep. 26, 1990 [KR] Rep. of Korea ..... 90-15323

[51] Int. Cl.[5] ..... F25D 17/04

[52] U.S. Cl. ..... 62/408; 251/253

[58] Field of Search ..... 62/404, 408, 419, 441; 251/253

[56] References Cited

U.S. PATENT DOCUMENTS 2,263,456 11/1941 Darcy ..... 62/419
4,614,092 9/1986 Kim et al. ..... 62/408
4,633,900 1/1987 Suzuki ..... 137/504
4,920,765 5/1990 McCauley et al. ..... 62/408
5,097,675 3/1992 Elsom et al. ..... 62/408

*Primary Examiner*—Henry A. Bennet
*Assistant Examiner*—William C. Doerrler
*Attorney, Agent, or Firm*—Burns, Doane, Swecker & Mathis

[57] ABSTRACT

A refrigerator includes a refrigerating chamber, a damper for opening and closing a cooling air supply channel, and an actuator for displacing the damper. A spring biases the damper closed. The actuator includes a rotary knob which rotates a cam disk. Rotation of the cam disk in one direction opens the damper against the spring bias. The knob includes a plurality of recesses which are selectively engageable by an elastic pin to yieldably retain the knob in various positions of damper adjustment.

9 Claims, 5 Drawing Sheets

REFRIGERATING COMPARTMENT TEMPERATURE CONTROL DEVICE

BACKGROUND OF THE INVENTION

1. Field of the Invention

The invention is related to a refrigerating compartment temperature control device for use in a refrigerator and the like.

Among the many types of refrigerating compartment temperature control devices, a typical model is described in U.S. Pat. No. 4,614,092. In this device, a control knob for regulating cooling-air flow is provided with a cam on a portion of the rear surface of the knob. The side face of the cam forms a sloped surface. A support lever is operatively linked to a cooling-air flow regulator by the sloped surface of the cam such that upon movement of the control knob the cooling-air flow volume is controlled.

In the above control device, when cooling air flows into the refrigerating compartment through the cooling air channel, cooling air strikes against a control plate which controls the amount of cooling air volume entering the refrigerating compartment. However, the lever connected to the control plate is pushed in the direction of flow of the cooling air with the result that the knob is unintentionally rotated across the slope surface. This creates the potential problem for not maintaining a constant and continuous flow of cooling air.

SUMMARY OF THE INVENTION

An object of the present invention is to provide a refrigerating compartment temperature control device in a refrigerator for solving the above problem.

Another object of the present invention is to provide a refrigerating compartment temperature control device with a control knob which cannot be unintentionally rotated and which has a greater reliability in supplying a continuous flow of cooling air.

In accordance with a preferred embodiment of the present invention, the refrigerating compartment temperature control device comprises a knob having a sector gear and a plurality of holes formed along the circumference of the knob at a predetermined distance from a shaft of the knob;

a stopper having a pin inserted into a hole of the plurality of holes formed in the knob for avoiding a restoring rotation of the knob;

a plane cam having a pinion formed integrally on a shaft of the cam and engaged with the sector gear, and having a configuration portion formed with a maximum lift point and a minimum lift point, respectively;

a damper control means having a sliding portion, i.e. a cam follower, which is formed at one end thereof and which travels along the configuration portion of cam;

a damper having a cooling air flow control portion for closing or opening the cooling air channel at one end of the damper and a coupling at the opposite end of the damper to couple the damper to the damper control means; and an elastic means connecting with the cooling air flow control portion of the damper with the elastic means providing a restoring force to the cooling air flow control portion.

As a result of the above structure, the cam is rotated in accordance with the rotation of the knob so as to open the cooling air channel for supplying the cooling air into the refrigerating chamber. The rotation of the cam is converted into linear movement of the damper control means to control the opening or closing of the damper. The damper is inclined or biased to close the cooling air channel due to the restoring force of the spring. The movement of the damper leads the reverse rotation of the knob. The pin is inserted into the hole to prevent the knob from unintentionally rotating, thereby maintaining a constant flow of cooling air as desired.

Furthermore, when the knob is rotated in the reverse direction so as to close the cooling air channel, the cam also is rotated in the reverse direction and the damper control means is moved to the minimum lift point of the cam. To maintain the closed cooling air flow control portion, the pin is inserted into the corresponding hole, thereby maintaining the closed cooling air flow control portion.

BRIEF DESCRIPTION OF DRAWINGS

The invention will be explained in detail below by reference to the accompanying drawings, in which.

DETAILED DESCRIPTION OF A PREFERRED EMBODIMENT

Figure 1:
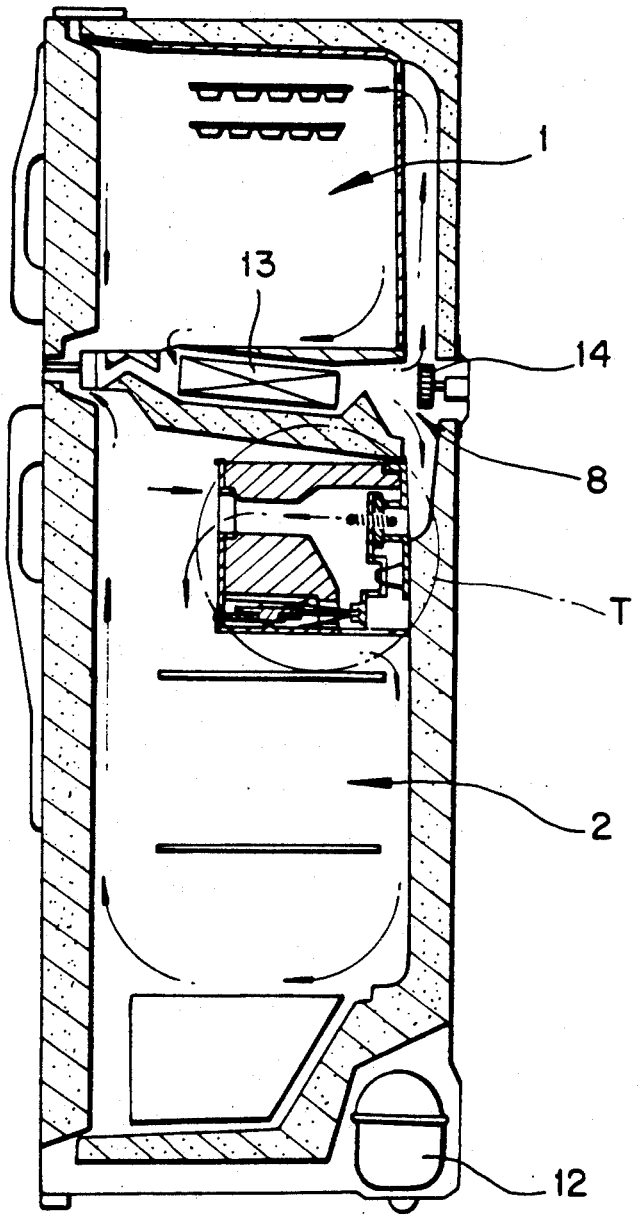
FIG. 1 is a cross-sectional view of a refrigerator with a refrigerating compartment temperature control device of the present invention.

In FIG. 1, a refrigerator generally comprises a freezing compartment 1 and a refrigerating compartment 2 in upper and lower portions of the interior thereof, respectively. In the lower portion of the refrigerating compartment 2 a conventional compressor 12 is located. Between the freezing compartment 1 and the refrigerating compartment 2 a conventional evaporator 13 is placed. The cooling air generated from the evaporator 13 is diverged to flow into the freezing compartment 1 and into the refrigerating compartment 2 through a cooling air channel 8 by a fan 14 disposed on a rear wall of the refrigerator.

A refrigerating temperature control device T is mounted on an exit portion of the cooling air channel 8 which directs the cooling air flow to the refrigerating compartment 2. The control device T is positioned in a case C which is formed as a cube as shown in FIG. 2.

Figure 2:
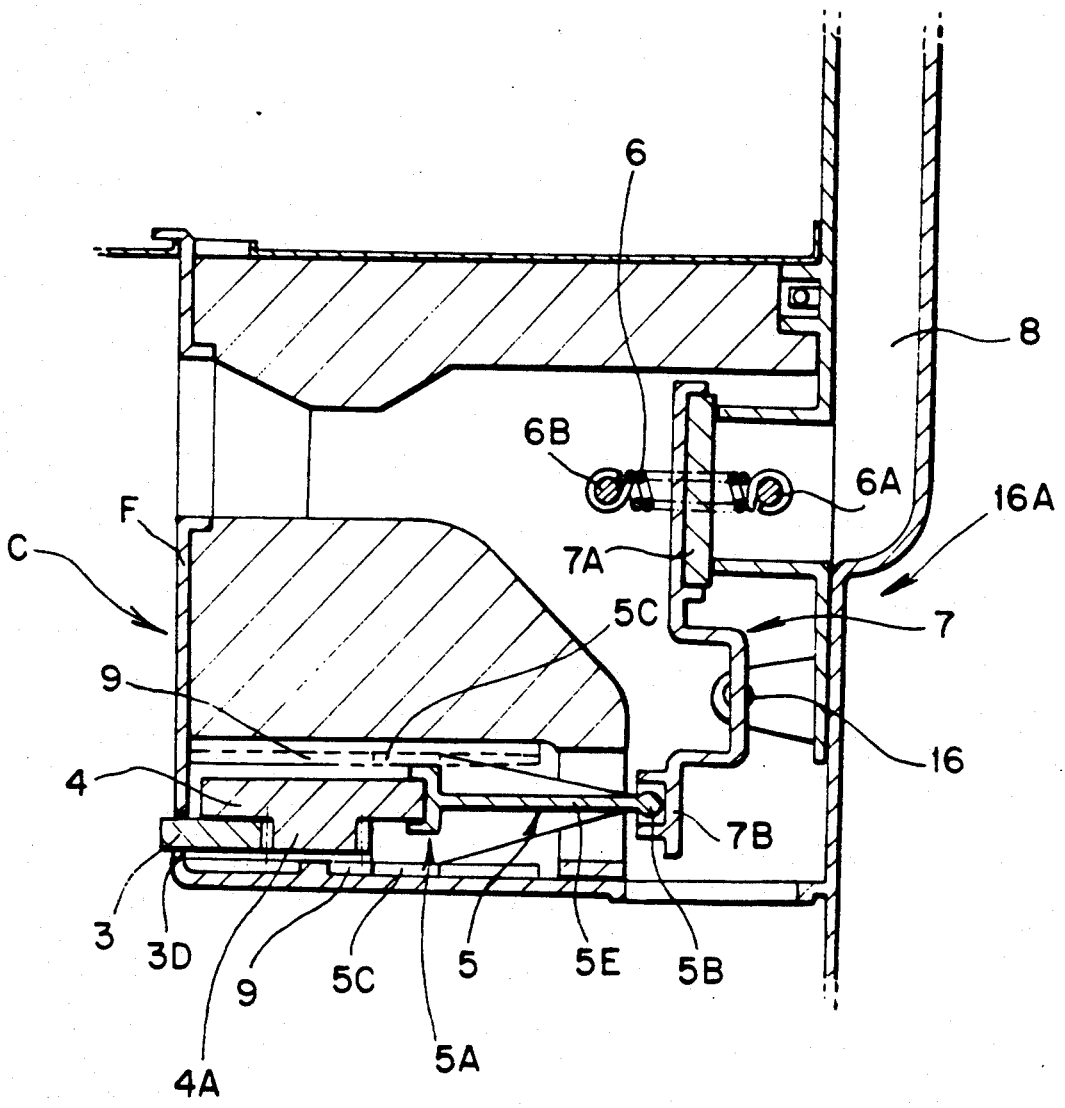
FIG. 2 is a cross-sectional view of the refrigerating compartment temperature control device of the present invention.
Figure 5:
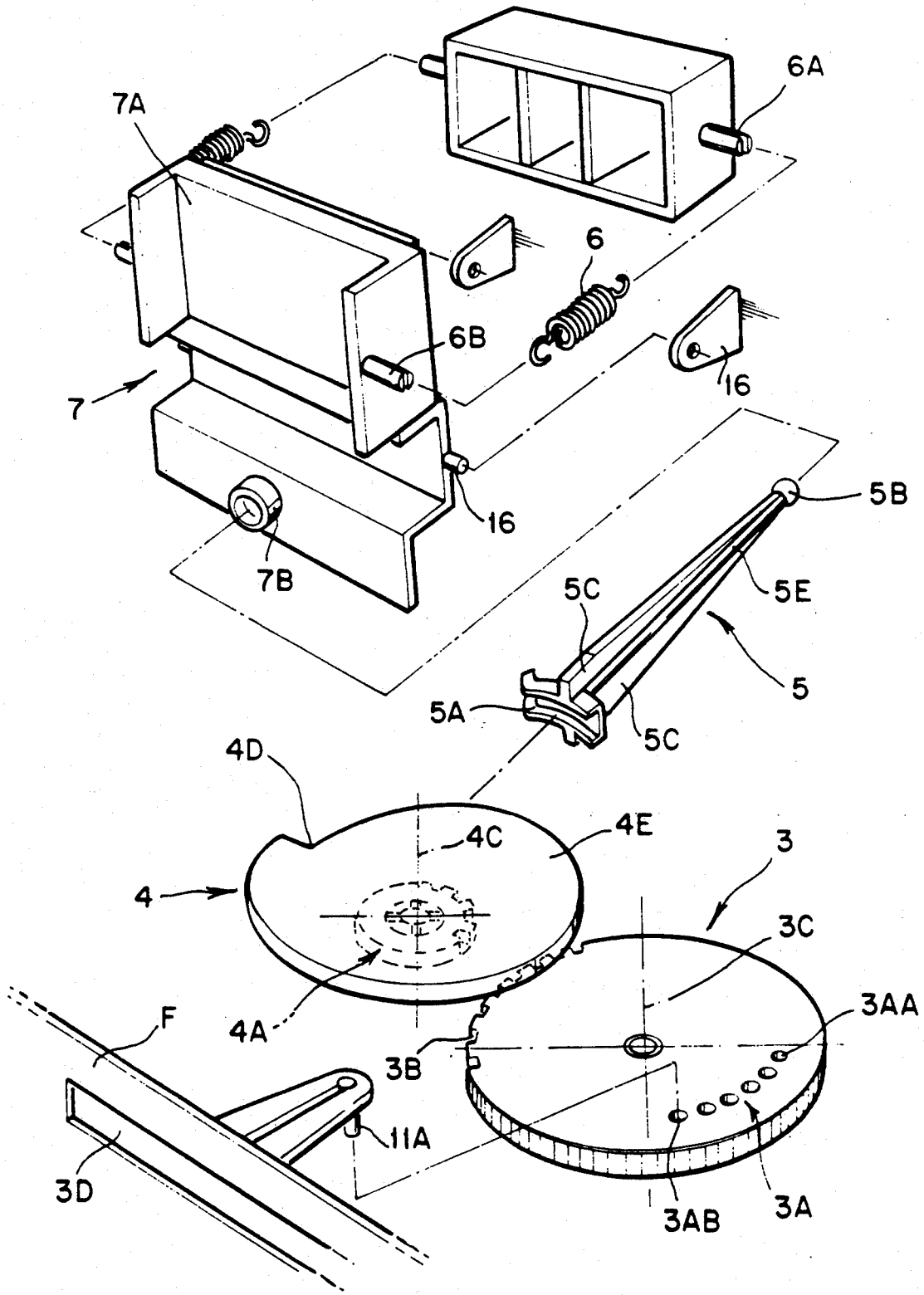
FIG. 5 is an exploded perspective view of the refrigerating compartment temperature control device of the present invention.

In FIGS. 2 and 5, a flat knob 3 is installed with a part thereof protruding through an opening 3D which is formed in a front wall F of the case C. The flat knob 3 has a sector gear 3B on a part of the circumferential side face of the knob 3 and a serration to prevent it from slipping on to the remaining part of circumferential side face thereof. On the upper face of the knob 3, a plurality of holes 3A is formed along inwardly of the circumference of the knob at a predetermined distance from the shaft 3C of the knob 3 for removeably receiving a pin 11A which will be discussed below.

A pinion 4A is provided on the lower surface of a cam 4. The pinion 4A engages the sector gear 3B and is coaxially arranged with respect to the cam 4. The cam 4 has a configuration portion 4B with a predetermined width which is provided with a maximum lift point 4D and a minimum lift point 4E, respectively.

The damper control means 5 has a sliding portion 5A, i.e. a cam follower, formed at an end of the control means 5 as shown in FIGS. 2 and 5. The sliding portion 5A is formed to travel along the width of the configuration portion 4B in a clockwise or a counter-clockwise direction, as see FIG. 5. In this embodiment the sliding portion 5A is shaped to have a "U" shaped form in its cross-section. At the other end of the damper control means 5 a ball 5B is formed which is connected to a socket 7B of a damper 7. A connecting portion 5E formed between the sliding portion 5A and the ball 5B, has fins 5C in a down-ward extending and an up-ward extending manner respectively, as shown in FIGS. 2 and 5. Parallel front edges of the fins 5C are closely fitted to rails 9 which are formed over the fins 5C so as to promote a straight forward and backward movement of the fin 5C.

The damper 7 is provided with a socket 7B at one end thereof so as to be coupled with the ball 5B, and a cooling air flow control portion 7A at the other end thereof so as to close/open an exit of the cooling air channel 8. The damper further includes a projecting portion 16 between the socket 7B and a cooling air flow control portion 7A of the damper. The projecting portion extends parallel to a horizontal line of the surface of the cooling air flow control portion 7A and that of the socket 7B, as shown at FIG. 2. The damper 7 is hingedly secured at the projecting portion 16. This hinging arrangement enables the control portion 7A to move in an opposite direction relative to the forward and backward movement of the damper control means 5, respectively.

Figure 3:
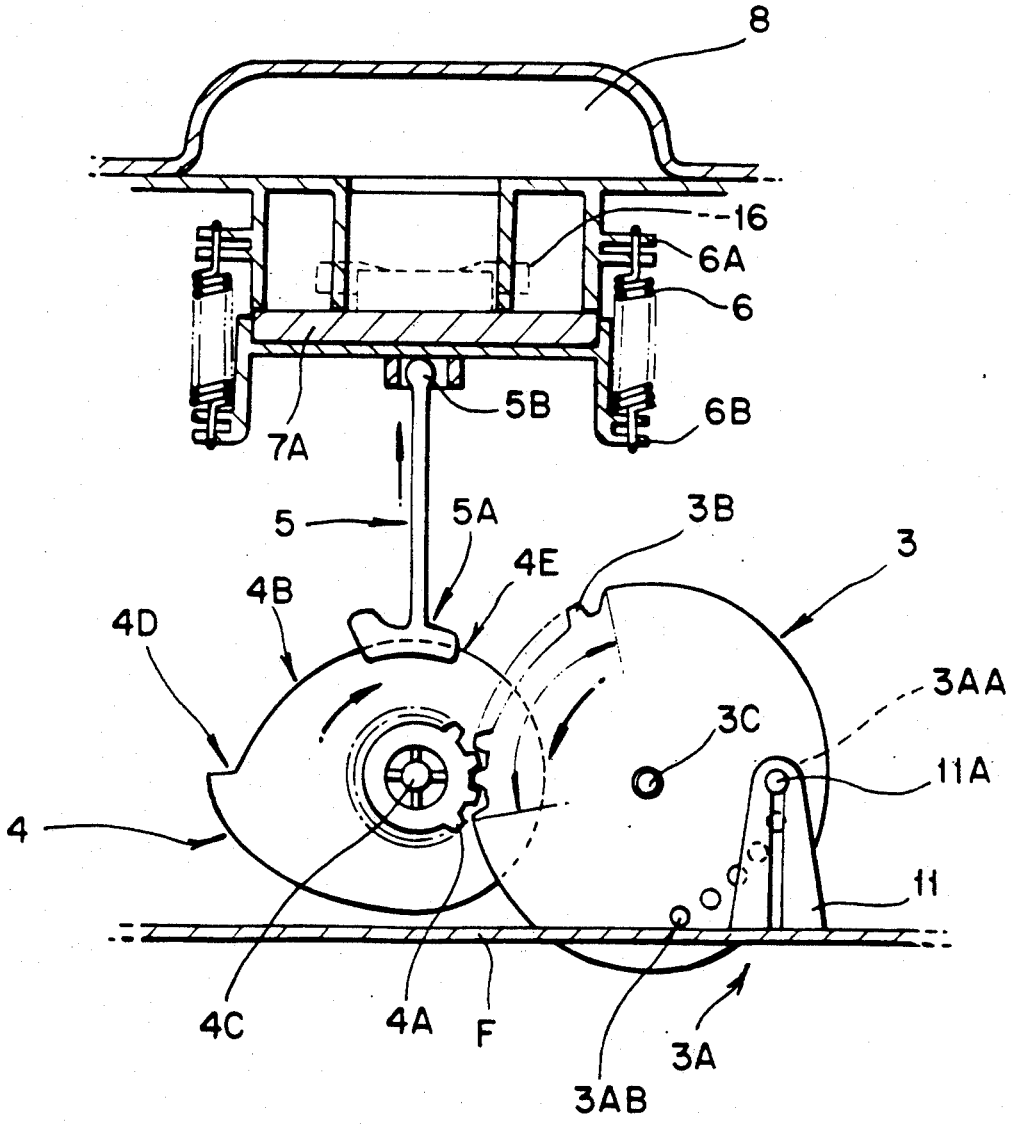
FIG. 3 is an upper plane view of the refrigerating compartment temperature control device of the present invention showing the condition when a damper is in a closed position.

As shown in FIGS. 3 and 5, an extension coil spring 6 is mounted at each side of the control portion 7A, with one hook connected to a pin 6A of an outer wall of the exit of the cooling air channel 8, and the remaining (opposite) hook connected to a pin 6B of a flange of the control portion 7A of the damper. Thus, the spring 6 provides a restoring force to the control portion 7A such that the control portion 7A is tensioned to close the exit of the cooling air channel 8.

To prevent the knob 3 from being unintentionally reverse-rotated from the tension of the spring 6, a stopper 11 having a pin 11A is mounted on the front wall F of the case C. The pin 11A is provided with a round portion at an free end thereof, and a middle portion having an elastic property, which leads to smooth insertion into the hole 3A and extraction from the hole 3A in order to prevent the knob 3 from unintentionally reverse-rotating. The purpose of stopper 11 is to resist unintended rotation of knob 3 while permitting intended rotation of knob 3.

The refrigerating temperature control device in the invention operates as following, with reference to the figures.

Figure 4:
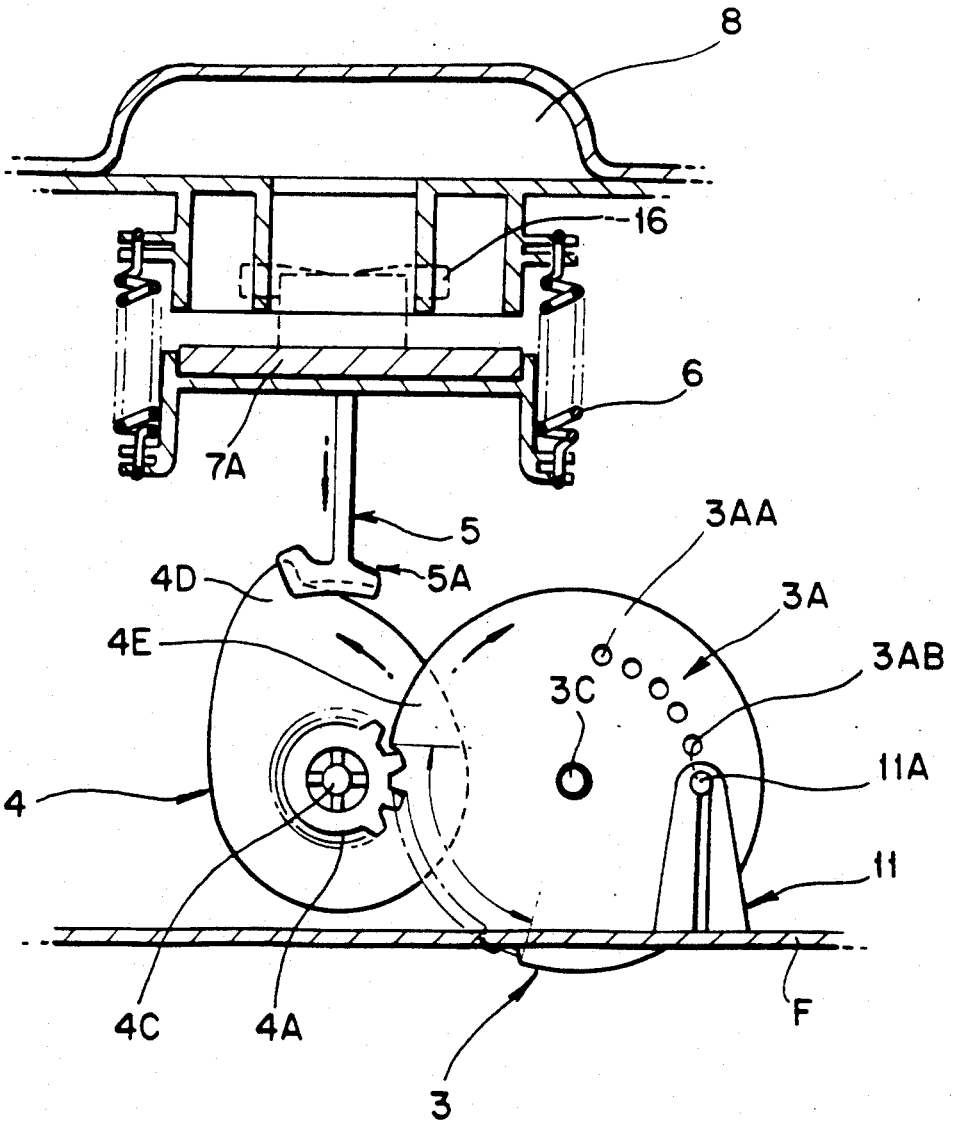
FIG. 4 is an upper plane view of the refrigerating compartment temperature control device of the present invention showing the condition when a damper is in an opened position.

FIG. 3 shows the cooling air channel 8 closed by the damper 7. The knob 3 is rotated counterclockwise by manipulating that portion of the knob which extends through the opening 3D in wall F and thus the pinion 4A which is engaged with the section gear 3B, is rotated in a clockwise direction. At this time, the configuration portion 4B of the flat cam 4 is rotated in a clockwise direction. With the rotation of the plane cam 4, the sliding portion 5A of the damper control means 5 travels between the minimum lift point 4E and the maximum lift point 4D on the periphery of the cam 4. Therefore, the rotational movement of the cam 4 is converted into a linear movement of the damper control means 5. That is, the damper control means 5 travels in toward the right side of the page illustrating FIG. 2. With the movement of the damper control means 5, the cooling air flow control portion 7A of the damper 7 moves to toward the left side of the page showing FIG. 2, against the restoring force of the spring 6, thereby opening the cooling air channel 8. Upon the intentional counterclockwise rotation of knob 3, pin 11A, inserted into the hole 3AA corresponding the minimum lift point 4B, is removed from the hole 3AA, and is inserted into the next hole and upon further intentional counterclockwise rotation of knob 3 is moved from the next hole and inserted into the next hole in a clockwise direction. In the end, the pin 11A is inserted in the hole 3AB which corresponds with the maximum lift point 4D. This condition, i.e. when the sliding portion 5A is at the maximum lift point 4D of the cam 4 is shown in FIG. 4.

On the other hand, when increasing the temperature of the refrigerating compartment 2, the knob 3 is rotated in a clockwise direction. The pinion 4A, which engages the section gear 3B, is rotated in a counterclockwise direction. Thus, the cam 4 is rotated in a counterclockwise direction.

As shown in FIG. 2, the cooling air flow control portion 7A of the damper 7 is moved by the restoring force of the spring 6 to a closed position to close off the channel 8.

The socket 7B of the damper 7 is moved in an opposite direction of the cooling air flow control portion 7A because of the hinge 16A which enables the damper to pivot about the hinge 16A. The damper control means 5 travels toward the left side of the page illustrating FIG. 2. In FIG. 3, the sliding portion 5A of the damper control means 5 is smoothly moved toward the minimum lift point 4E along the configuration portion 4B, and thus the damper control means 5 is moved downward from its previous position, the maximum lift point 4D. At that time, the close/open range of the cooling air flow control portion 7A is determined by the pin 11A which is inserted into the hole 3A of the knob 3. The condition when the sliding portion 5A is contacted with the minimum lift point 4E of the cam 4 is shown in FIG. 3.

According to the refrigerating temperature control device as described above, cooling air volume which flows to the refrigerating compartment as the range of the close/open of the cooling air channel, is a continuous and constant flow when the range is set, thereby enhancing the reliability of the refrigerator.

What is claimed is:

1. A refrigerator comprising:

frame means defining a refrigerating chamber;

means for supplying cold air to said refrigerating chamber through a cold air channel;

a damper including a channel closing portion and being mounted for movement in a first direction such that said channel closing portion moves away from said channel and in a second direction such that said channel closing portion moves toward said channel, said damper being pivotably mounted for rotation about a horizontal axis;

biasing means for biasing said damper in one of said first and second directions; and actuating means operably connected to said damper for moving said damper in the other of said first and second directions against the bias of said biasing means, said actuating means comprising:

a rotary means including a rotary knob and a cam surface rotatable with said rotary knob and operably connected to said damper for moving said damper in said other of said first and second directions, said rotary knob being rotatable about a vertical axis; and a pin-and-recess coupling for yieldably retaining said rotary means in various positions of angular adjustment.

2. A refrigerator according to claim 1, wherein said rotary means comprises a rotary cam carrying said cam surface and operably connected to said rotary knob for rotation therewith, and a control member operably connected at one end to said damper and connected to said cam at its other end, said cam being rotatable relative to said other end and capable of displacing said control member for moving said damper.

3. A refrigerator according to claim 2, wherein said rotary knob is connected to said rotary cam by gear teeth.

4. A refrigerator according to claim 1, wherein said one of said first and second directions comprises said second direction.

5. A refrigerator according to claim 1, wherein said pin-and-recess coupling comprises a pin mounted on one of said frame means and said rotary means, and a plurality of recesses in the other of said frame means and said rotary means.

6. A refrigerator according to claim 5, wherein said pin is mounted on said frame means and said rotary knob carries said plurality of recesses.

7. A refrigerator according to claim 5, wherein said pin is elastic.

8. A refrigerator comprising:

frame means defining a refrigerating chamber;

means for supplying cold air to said refrigerating chamber through a cold air channel;

a damper disposed outside of an end of said cold air channel and having a channel closing portion, said damper being pivotably mounted to said frame such that said channel closing portion is movable away from said end of said cold air channel when said damper pivots in a first direction, and is movable toward said end of said cold air channel when said damper pivots in a second direction;

biasing means for biasing said damper in one of said first and second directions; and actuating means operably connected to said damper for moving said damper in the other of said first and second directions against the bias of said biasing means, said actuating means comprising:

a rotary means including a rotary knob, a cam surface rotatable with said rotary knob, and a control member operably connected at one of its ends to said cam surface, and pivotably connected at another of its ends to said damper, said cam surface being rotatable relative to said control member for displacing said control member to pivot said damper, and a pin-and-recess coupling for yieldably retaining said rotary means in various positions of angular adjustment, said pin being elastically biased to a retaining position.

9. A refrigerator according to claim 8, wherein said rotary means comprises a rotary cam carrying said cam surface, said rotary knob being connected to said rotary cam by gear teeth.

* * * * *